US006202427B1

(12) United States Patent
Weng

(10) Patent No.: US 6,202,427 B1
(45) Date of Patent: Mar. 20, 2001

(54) REFRIGERATING AIR-CONDITIONING SYSTEM FOR REDUCING AND REUSING WASTE ENERGY

(75) Inventor: Kuo-Liang Weng, Taichung (TW)

(73) Assignee: Yiue Feng Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 09/263,864

(22) Filed: Mar. 8, 1999

(51) Int. Cl.[7] ..... F25B 27/00; F25D 17/00
(52) U.S. Cl. ..... 62/159; 62/201; 62/238.6
(58) Field of Search ..... 62/201.1, 59, 238.7, 62/238.6

(56) References Cited

U.S. PATENT DOCUMENTS 3,301,002 * 1/1967 McGrath ..... 62/175
3,926,008 * 12/1975 Webber ..... 62/238.6
4,251,996 * 2/1981 Esformes et al. ..... 62/238.6

* cited by examiner

*Primary Examiner*—William Wayner
(74) *Attorney, Agent, or Firm*—Rosenberg, Klein & Lee

(57) ABSTRACT

The present invention relates to a refrigerating air-conditioning system which can be used to reduce and reuse waste energy. The system includes a fan motor which is used to supply a variable wind rate to an intermediate heat exchanger. In such a manner, when the cold making requirement is greater than the heat making requirement, the intermediate heat exchanger functions as an auxiliary condenser so as to variably change the waste heat needed to be drained from the refrigerating air-conditioning system. When the heat making requirement is greater than the cold making requirement, the intermediate heat exchanger functions as an evaporator so as to variably change the heat needed to be absorbed by the refrigerating air-conditioning system. When the cold and heat making requirements exist synchronously, the intermediate heat exchanger functions as an auxiliary condenser so as to change the waste heat needed to be drained from the refrigerating air-conditioning system.

12 Claims, 7 Drawing Sheets

REFRIGERATING AIR-CONDITIONING SYSTEM FOR REDUCING AND REUSING WASTE ENERGY

BACKGROUND OF THE INVENTION

1. Field of the Invention

The present invention relates to a refrigerating air-conditioning system which can be used to reduce and reuse waste energy.

2. Description of the Related Prior Art

A conventional refrigerating air-conditioning system will exhaust a great deal of energy during its operation, thereby causing waste of energy. In addition, the waste energy drained from the conventional refrigerating air-conditioning system easily incurring a heat pollution to the environment. The present invention has arisen to overcome the disadvantages of the conventional refrigerating air-conditioning system.

SUMMARY OF THE INVENTION

The primary objective of the present invention is to provide a refrigerating air-conditioning system which can be used to reduce and reuse waste energy.

The refrigerating air-conditioning system includes a fan motor which is used to supply a variable wind rate to an intermediate heat exchanger which functions to adjust the heat exchange capacity of the refrigerating air-conditioning system such that the refrigerating air-conditioning system is operated at its highest efficiency, thereby reducing production of the waste energy so as to save energy.

Further objectives and advantages of the present invention will become apparent after a careful reading of the detailed description with reference to the accompanying drawings.

DETAILED DESCRIPTION OF THE PREFERRED EMBODIMENTS

Figure 1:
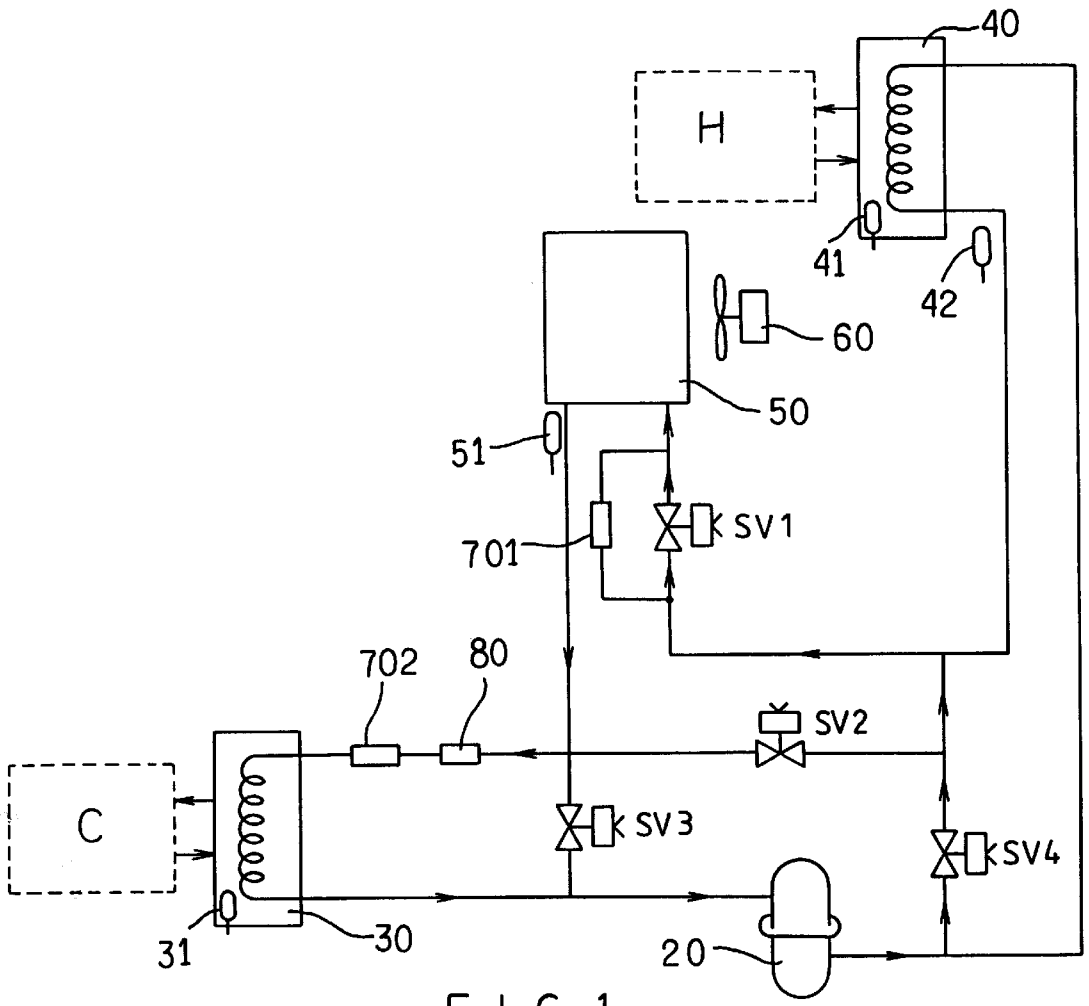
FIG. 1 is an operational schematic view of refrigerating air-conditioning system according to the present invention, wherein the first operation mode is executed.

With reference to FIG. 1, a refrigerating air-conditioning system according to the present invention can be used to reduce and reuse waste energy, and comprises a compressor 20, a cold making tank 30, a heat making tank 40, an intermediate heat exchanger 50, a plurality of electromagnetic valves SV1, SV2, SV3, and SV4, a fan motor 60, a plurality of temperature sensors 31, 41, 42 and 51, a pair of refrigerant flow controllers 70 such as a capillary tube, and expansion valve and the like, and a drying filter 80.

The compressor 20 is used to supply power to the circulating refrigerant.

The cold making tank 30 similar to the evaporator of the refrigerating air-conditioning system can be used to supply cold source to a cold requiring room C.

The heat making tank 40 contains a heat exchanger mounted therein which is similar to the condenser of the refrigerating air-conditioning system, whereby, the heat making tank 40 can be used to supply heat source to a heat requiring room H.

The intermediate heat exchanger 50 is an air cooling type heat exchanger or a water cooling type heat exchanger which is composed of a pipe row.

The fan motor 60 is able to smoothly increase or decrease the rotational speed thereof so as to control the heat exchange capacity of the intermediate heat exchanger 50 such that the refrigerating air-conditioning system can be operated at its highest efficiency at any time, thereby efficiently using the energy.

The electromagnetic valves SV1, SV2, SV3 and SV4 are used to control the flow direction of the refrigerant such that the cold making tank 30, the heat making tank 40, and the intermediate heat exchanger 50 can function in correspondence with different operation modes.

The refrigerant flow controllers 70 are used to control the refrigerant flow.

The drying filter 80 is used to filter the impurities and to absorb the water contained in the refrigerating air-conditioning system.

In practice, the refrigerating air-conditioning system is operated according to three operation modes, wherein the first operation mode is executed when the cold making requirement is greater than the heat making requirement, the second operation mode is executed when the heat making requirement is greater than the cold making requirement, and the third operation mode is executed when the cold and heat making requirements exist synchronously.

Figure 7:
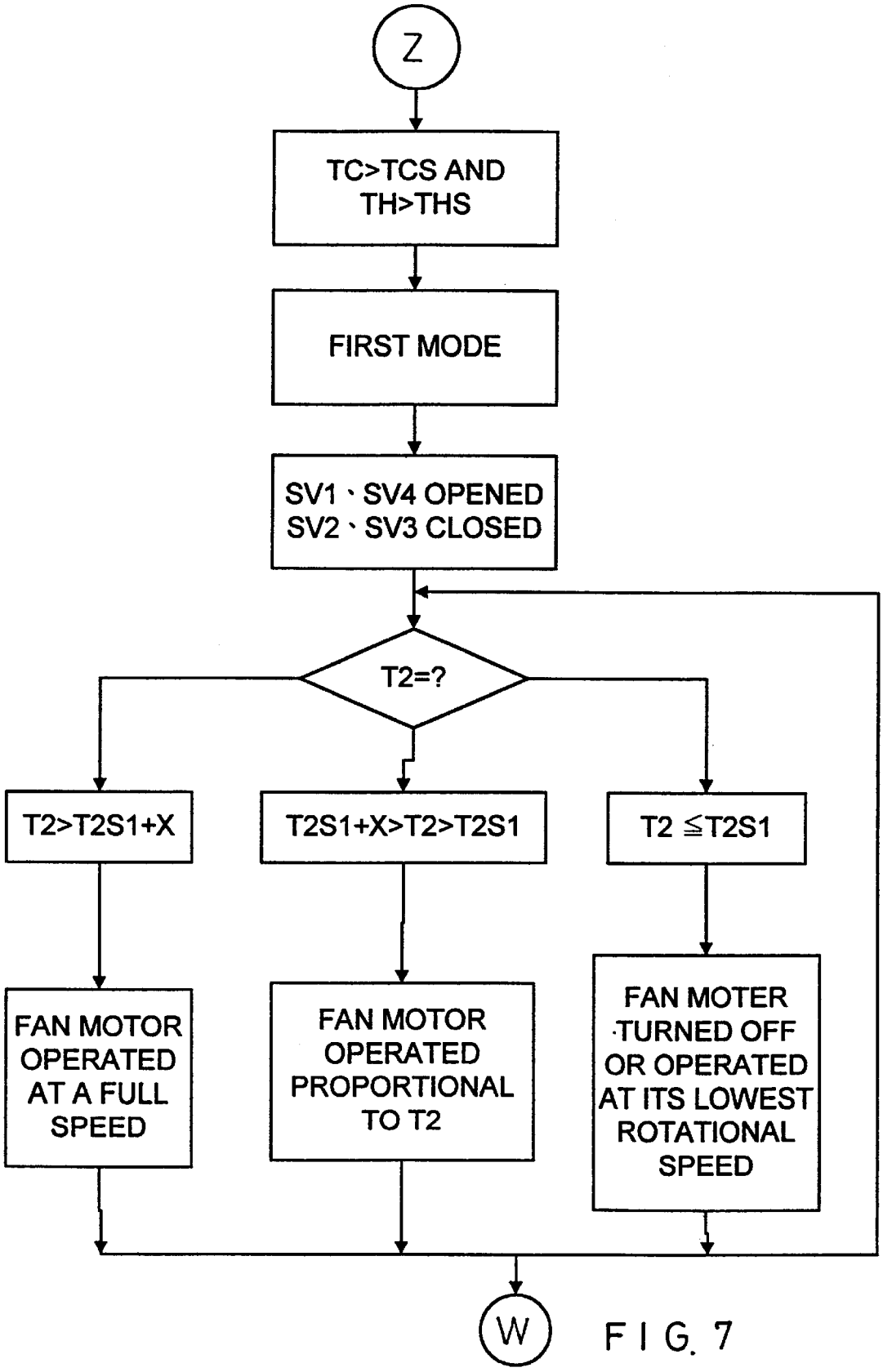
FIG. 7 is a flow chart of the refrigerating air-conditioning system as shown in FIG. 4, wherein the first mode is executed.

With reference to FIGS. 1 and 7, according to the first operation mode, the cold making requirements is greater than the heat making requirement.

Assuming the temperature of the cold making tank 30 detected by the sensor 31 of the cold making tank 30 is equal to TC, the setting temperature of the cold making tank 30 is equal to TCS, the temperature of the heat making tank 40 detected by the sensor 41 of the heat making tank 40 is equal to TH, and the setting temperature of the heat making tank 40 is equal to THS.

When TC>TCS, and TH>THS, it indicates that the cold making requirement is greater than the heat making requirement. Then, the two electromagnetic valves SV1 and SV4 are opened, and the two electromagnetic valves SV2, and SV3 are closed such that the refrigerant is circulated in the refrigerating air-conditioning system along direction as indicated by the arrows shown in FIG. 1.

Assuming the temperature of the refrigerant flowing from the intermediate heat exchanger 50 detected by the sensor 51 is equal to T2, and the high temperature setting value of the refrigerant is equal to T2S1. The fan motor 60 is used to supply a variable wind rate to the intermediate heat exchanger 50 according to the result of comparison of T2 with T2S1 so as to control the amount of heat exchange of the intermediate heat exchanger 50 such that the intermediate heat exchanger 50 can function as an auxiliary condenser during the circulating process of the first operation mode so as to change the waste energy in a variable adjustable manner which is needed to be drained from the refrigerating air-conditioning system.

The operation of the fan motor 60 is controlled in the following manner. When T2≦T2S1, the fan motor 60 is turned off or operated at its lowest rotational speed. When T2S1+X>T2>T2S1, wherein X is the difference of the setting value, the rotational speed of the fan motor 60 is proportional to the temperature value T2. When T2>T2S1+X, the fan motor 60 is operated at its full rotational speed.

Figure 2:
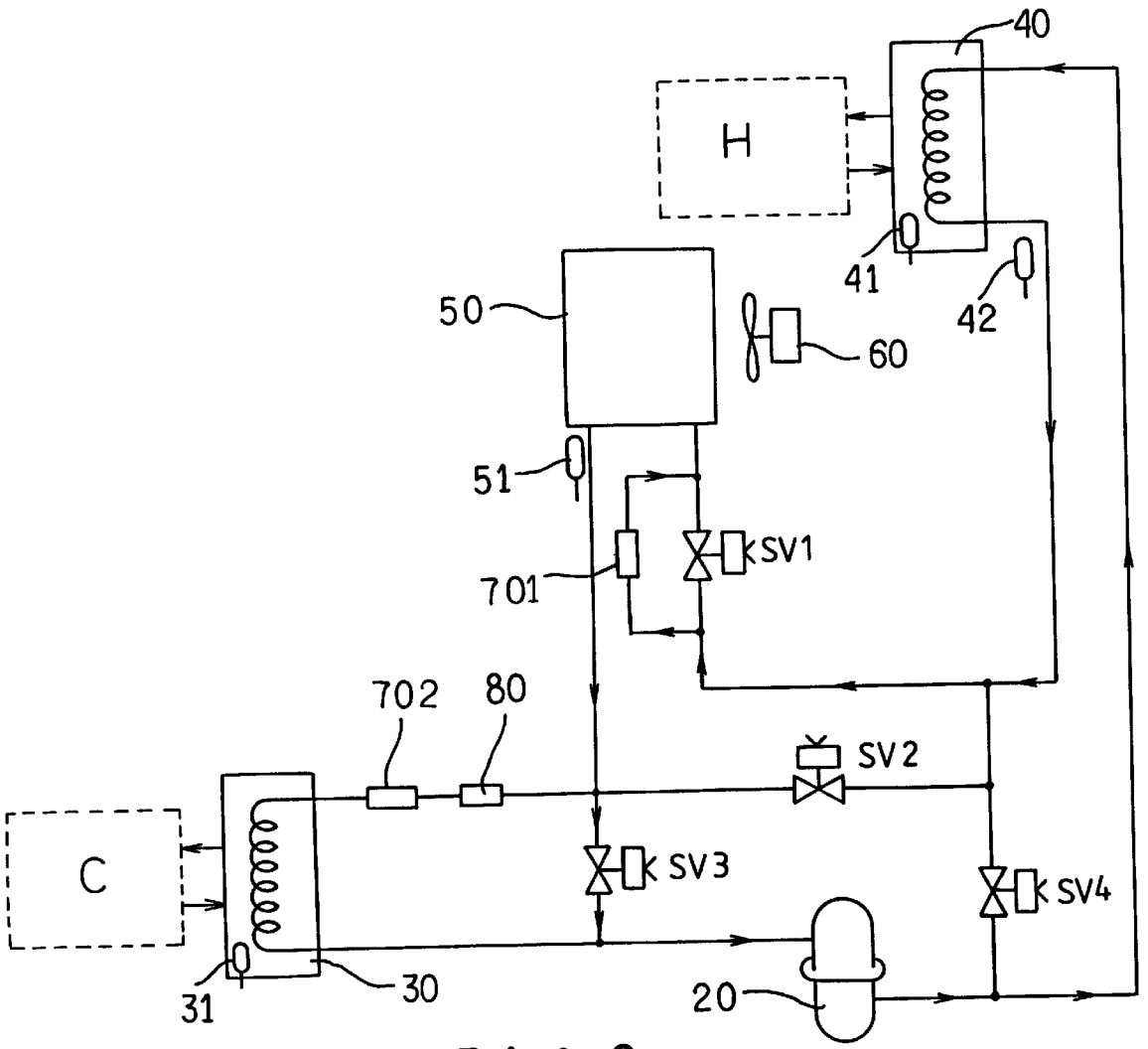
FIG. 2 is an operational schematic view of the refrigerating air-conditioning system as shown in FIG. 1, wherein the second operation mode is executed.
Figure 5:
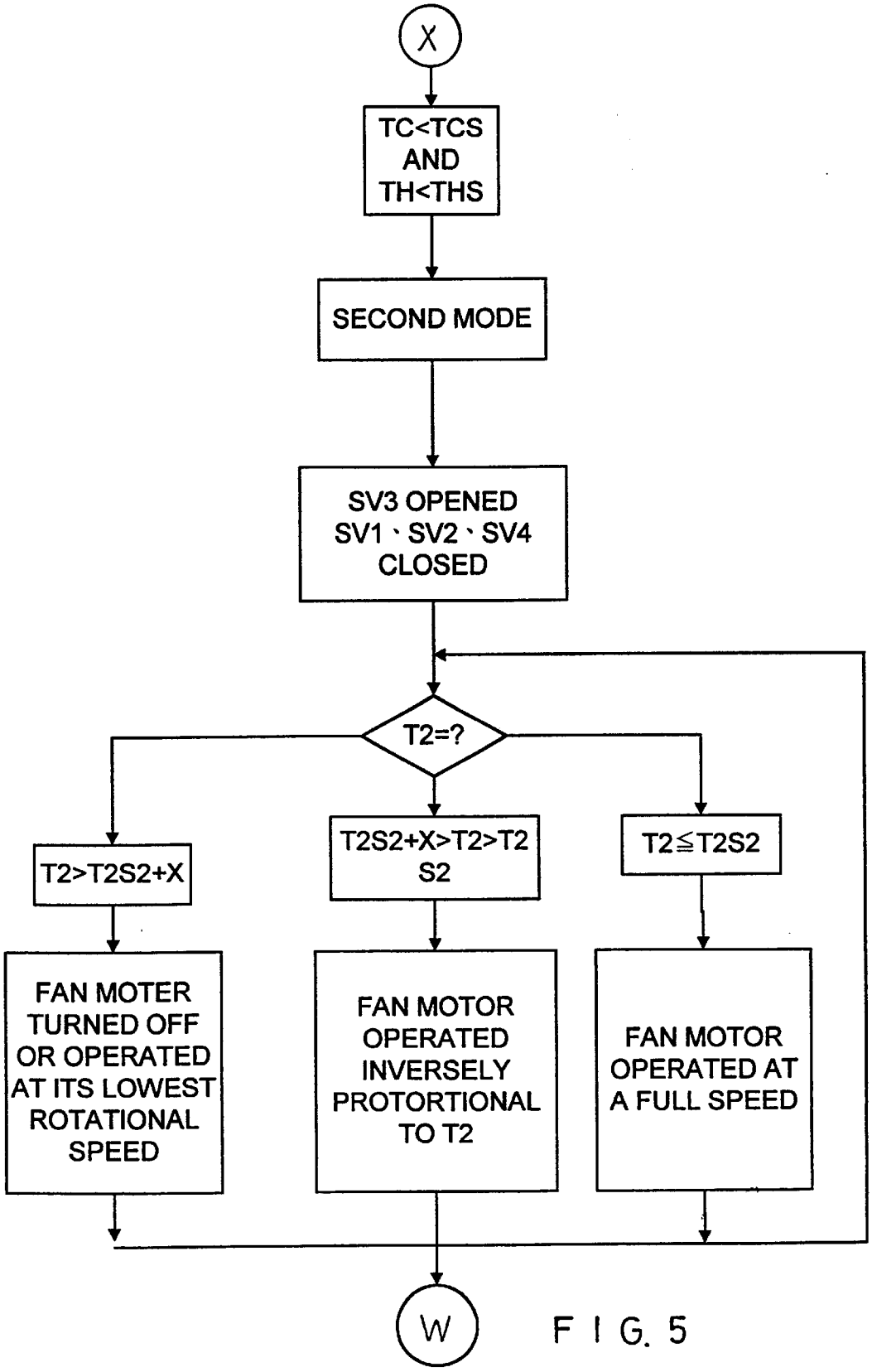
FIG. 5 is a flow chart of the refrigerating air-conditioning system as shown in FIG. 4, wherein the second mode is executed.

With reference to FIGS. 2 and 5, according to the second operation mode, the heat making requirement is greater than the cold making requirement.

When TC<TCS, and TH<THS, it indicates that the heat making requirement is greater than the cold making requirement. Then, the three electromagnetic valves SV1, SV2 and SV4 are closed, and the electromagnetic valve SV3 is opened such that the refrigerant is circulated in the refrigerating air-conditioning system along the direction as indicated by the arrows shown in FIG. 2.

Assuming the low temperature setting value of the refrigerant is equal to T2S2. The fan motor 60 is used to supply a variable wind rate to the intermediate heat exchanger 50 according to the result of comparison of T2 with T2S2 so as to control the amount of heat exchange of the intermediate heat exchanger 50. In the circulating process of the second mode, the intermediate heat exchanger 50 can be used to change the energy in a variable adjustable manner which is needed to be absorbed by the refrigerating air-conditioning system. Accordingly, the intermediate heat exchanger 50 can function as an evaporator.

The operation of the fan motor 60 is controlled in the following manner. When T2≦T2S2, the fan motor 60 is operated at its full rotational speed. When T2S2+X>T2>T2S2, the rotational speed of the fan motor 60 is inversely proportional to the temperature value T2. When T2>T2S1+X, the fan motor 60 is turned off or operated at its lowest rotational speed.

Figure 3:
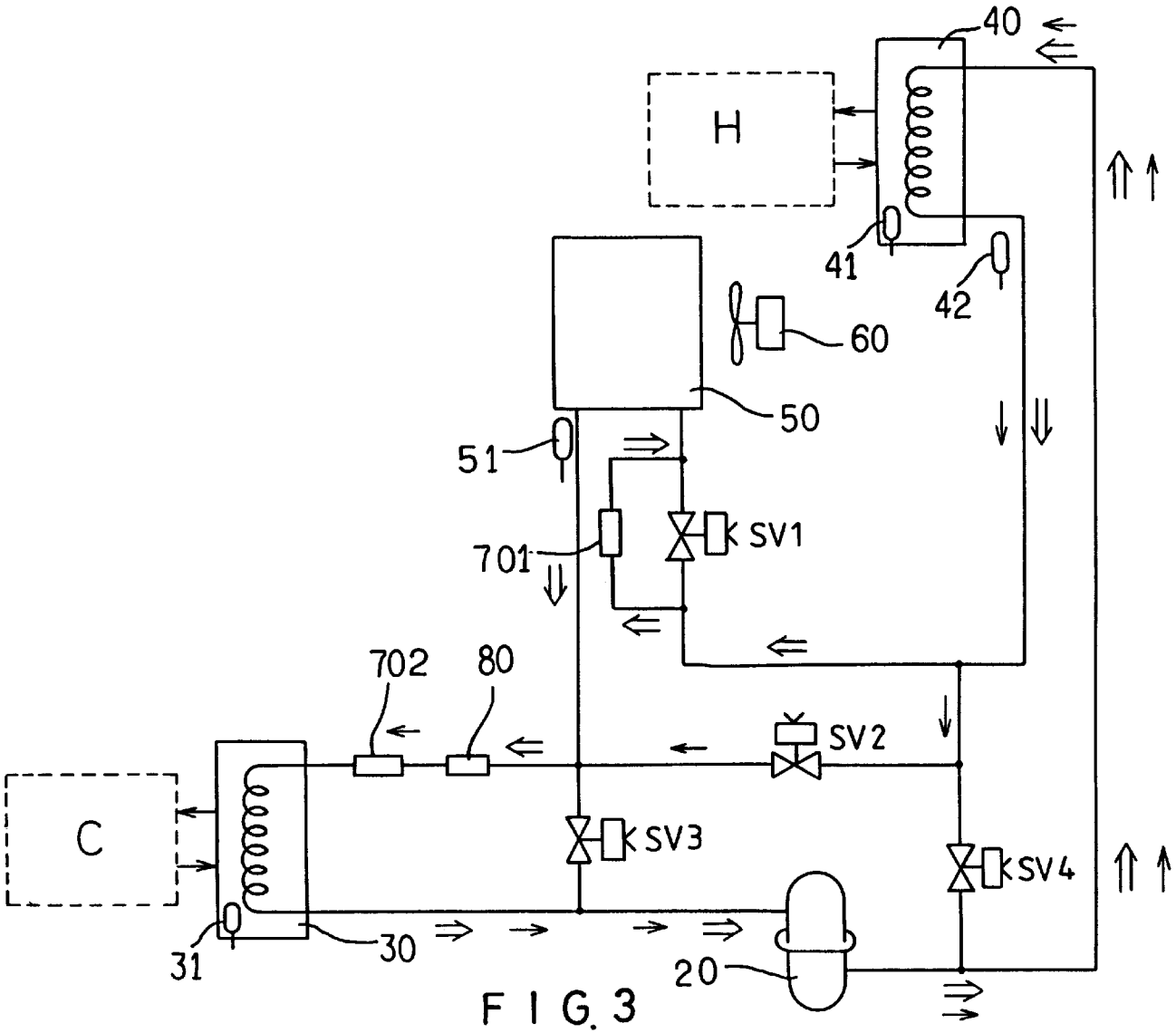
FIG. 3 is an operational schematic view of the refrigerating air-conditioning system as shown in FIG. 1, wherein the third operation mode is executed.
Figure 4:
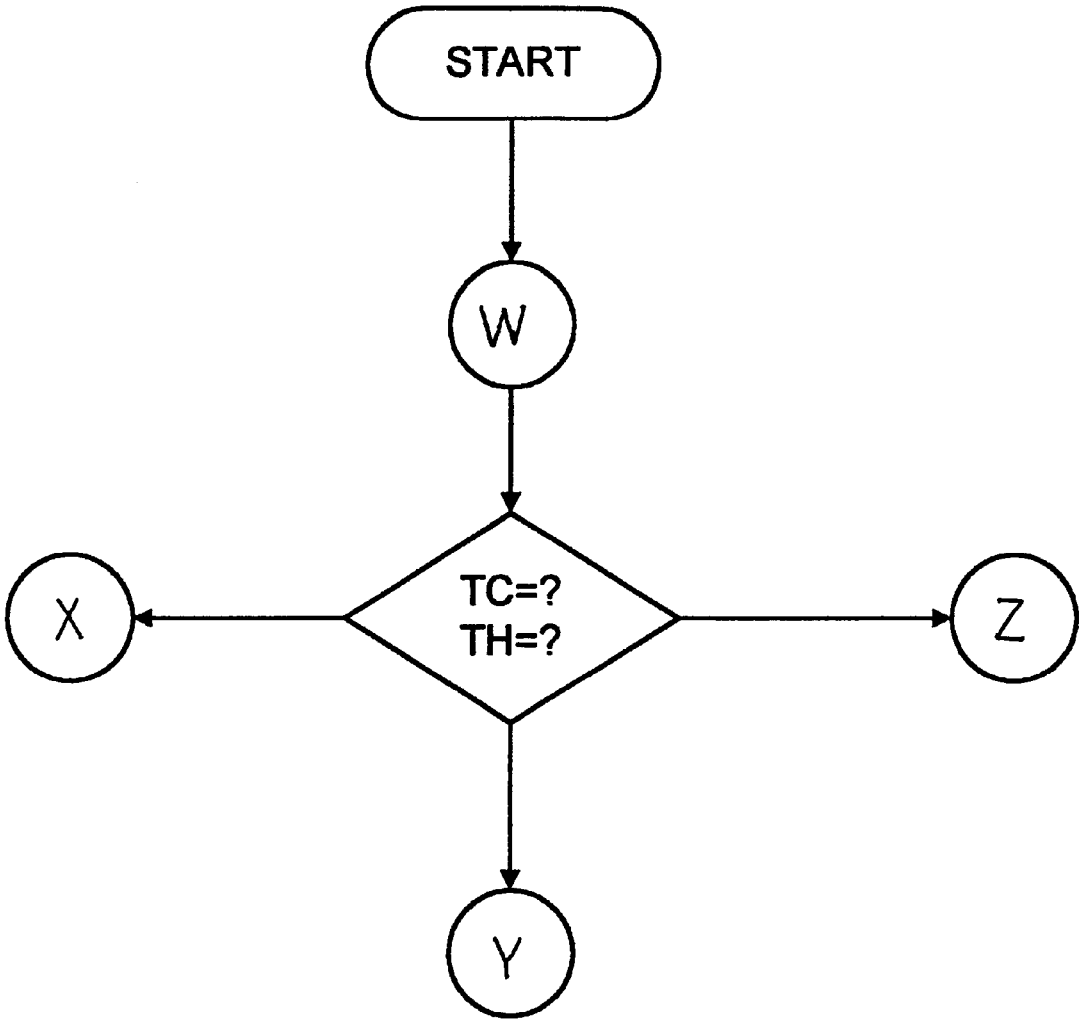
FIG. 4 is a flow chart of three operation modes of the refrigerating air-conditioning system according to the present invention.
Figure 6:
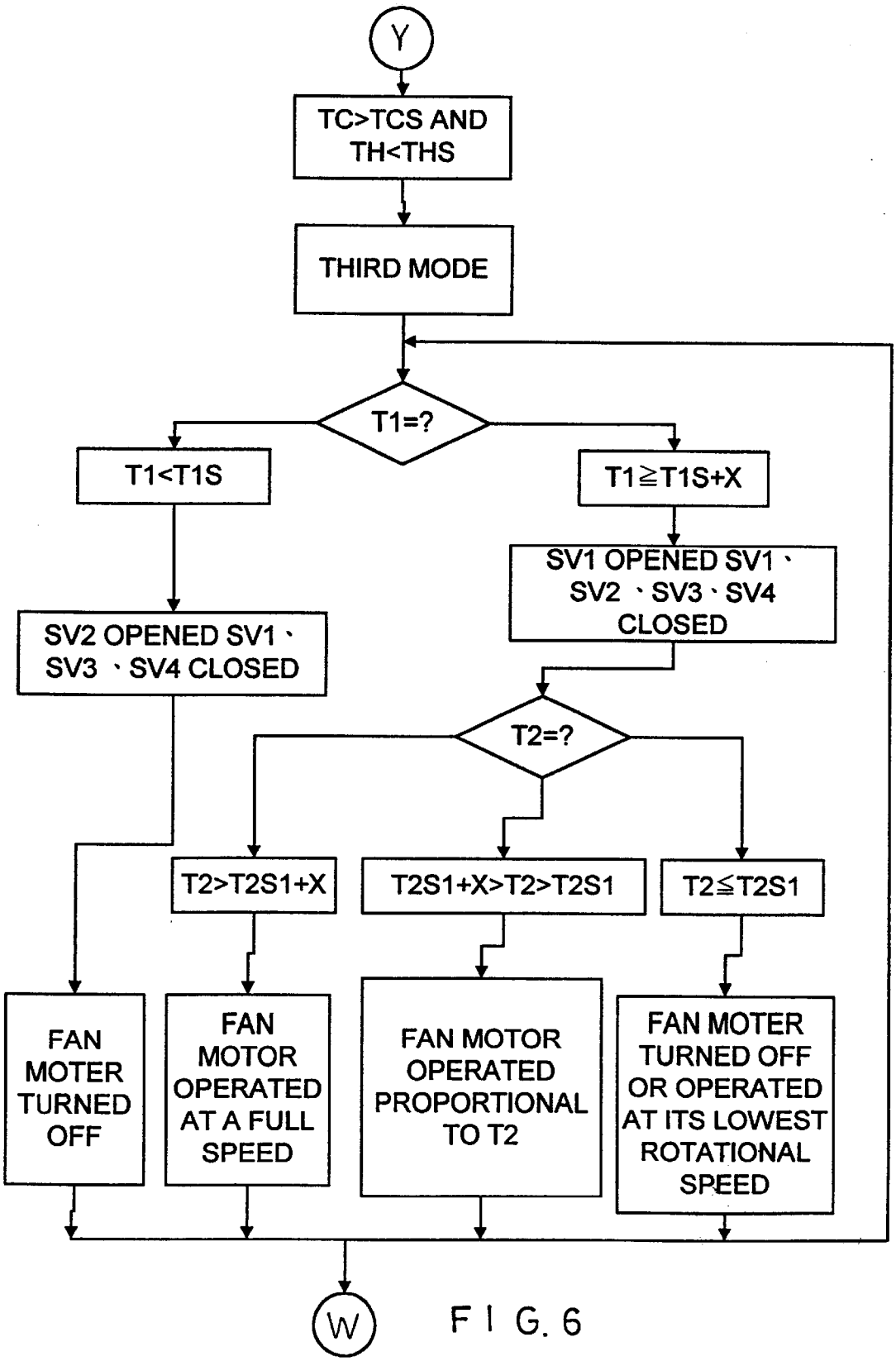
FIG. 6 is a flow chart of the refrigerating air-conditioning system as shown in FIG. 4, wherein the third mode is executed.

With reference to FIGS. 3 and 6, according to the third operation mode, the cold and heat making requirements exist synchronously.

When TC>TCS, and TH<THS, it indicates that the cold and heat making requirements exist synchronously.

Assuming the temperature of the refrigerant flowing from the heat making tank 40 detected by the sensor 42 is equal to T1, and the temperature setting value of the refrigerant is equal to T1S.

When T1≧T1S+X, the three electromagnetic valves SV2, SV3 and SV4 are closed, and the electromagnetic valve SV1 is opened such that the refrigerant is circulated in the refrigerating air-conditioning system along the direction as indicated by the double arrows shown in FIG. 3. In such a situation, the intermediate heat exchanger 50 can used to provide an auxiliary function to drain heat.

The fan motor 60 is used to supply a variable wind rate to the intermediate heat exchanger 50 according to the result of comparison of T2 with T2S1 so as to control the amount of heat exchange of the intermediate heat exchanger 50 such that the intermediate heat exchanger 50 can function as an auxiliary condenser during the circulating process of the third operation mode so as to change the waste energy in a variable adjustable manner which is needed to be drained from the refrigerating air-conditioning system.

The operation of the fan motor 60 is controlled in the following manner. When T2≦T2S1, the fan motor 60 is turned off or operated at its lowest rotational speed. When T2S1+X>T2>T2S1, wherein X is the difference of the setting value, the rotational speed of the fan motor 60 is proportional to the temperature value T2. When T2>T2S1+X, the fan motor 60 is operated at its full rotational speed.

When T1<T1S, the three electromagnetic valves SV1, SV3 and SV4 are closed, and the electromagnetic valve SV2 is opened such that the refrigerant is circulated in the refrigerating air-conditioning system along the direction as indicated by the arrows shown in FIG. 3. In such a situation, the fan motor 60 is turned off.

Accordingly, during the circulation process of the present system, the intermediate heat exchanger 50 in conjunction with the fan motor 60 providing a variable wind rate can be used to obtain an optimal heat exchange efficiency, thereby efficiently reducing production of the waste energy. In addition, the cold and heat making requirements exist synchronously such that the waste heat exhausted by the cold making tank 30 can be used as the heat source of the heat making tank 40, and the waste energy exhausted by the heat making tank 40 can be used as the cold source of the cold making tank 30, thereby efficiently reducing the waste energy so as to save energy.

Although the present invention has been described with a certain degree of particularity, it is to be understood that the present disclose has been made by way of example only and that many other possible modifications and variations can be made without departing from the scope and spirit of the present invention.

I claim:

1. A refrigerating air-conditioning system used to reduce and reuse waste energy comprising a compressor, a cold making tank, a heat making tank, an intermediate heat exchanger, a plurality of electromagnetic valves, a fan motor, a plurality of temperature sensors, a refrigerant pair of flow controllers, and a drying filter, wherein:

the compressor is used to supply power to a circulating refrigerant;

the cold making tank is used to supply cold source to a cold requiring room;

the heat making tank is used to supply heat source to a heat requiring room;

the intermediate heat exchanger is composed of a pipe row;

the fan motor is able to smoothly change the rotational speed thereof so as to control the heat exchange capacity of the intermediate heat exchanger such that the refrigerating air-conditioning system can be operated at its highest efficiency at any time, thereby efficiently using the energy;

the electromagnetic valves are used to control the flow direction of the circulating refrigerant such that the cold making tank, the heat making tank, and the intermediate heat exchanger can function in correspondence with different operation modes;

each refrigerant flow controller is used to control the flow of the circulating refrigerant;

the drying filter is used to filter the impurities and to absorb the water contained in the refrigerating air-conditioning system;

the refrigerating air-conditioning system is operated according to three operation modes, wherein the first operation mode is executed when the cold making requirement is greater than the heat making requirement, the second operation mode is executed when the heat making requirement is greater than the cold making requirement, and the third operation mode is executed when the cold and heat making requirements exist synchronously;

whereby, the fan motor is able to supply a variable wind rate to the intermediate heat exchanger which functions to adjust the heat exchange capacity of the refrigerating air-conditioning system such that the refrigerating air-conditioning system is operated at its highest efficiency, thereby reducing production of the waste energy.

2. The refrigerating air-conditioning system as claimed in claim 1, wherein according to the first operation mode, the cold making requirement is greater than the heat making requirement, then the fan motor is used to supply a variable wind rate to the intermediate heat exchanger such that the intermediate heat exchanger functions as an auxiliary condenser during the circulating process of the first operation mode so as to variably change the waste heat needed to be drained from the refrigerating air-conditioning system.

3. The refrigerating air-conditioning system as claimed in claim 1, wherein according to the second operation mode, the heat making requirement is greater than the cold making requirement, then the fan motor is used to supply a variable wind rate to the intermediate heat exchanger such that the intermediate heat exchanger functions as an evaporator during the circulating process of the second operation mode so as to variably change the heat needed to be absorbed by the refrigerating air-conditioning system.

4. The refrigerating air-conditioning system as claimed in claim 1, wherein according to the third operation mode, the cold and heat making requirements exist synchronously, then the fan motor is used to supply a variable wind rate to the intermediate heat exchanger such that the intermediate heat exchanger functions as an auxiliary condenser during the circulating process of the third operation mode so as to change the waste heat needed to be drained from the refrigerating air-conditioning system.

5. The refrigerating air-conditioning system as claimed in claim 1, wherein the waste heat exhausted by the cold making tank during the circulating process is reused as the heat source of the heat making tank.

6. The refrigerating air-conditioning system as claimed in claim 1, wherein the waste energy exhausted by the heat making tank during the circulating process is reused as the cold source of the cold making tank.

7. The refrigerating air-conditioning system as claimed in claim 1, wherein each refrigerant flow controller is a capillary tube.

8. The refrigerating air-conditioning system as claimed in claim 1, wherein each refrigerant flow controller is an expansion valve.

9. The refrigerating air-conditioning system as claimed in claim 1, wherein the cold making tank functions as the evaporator of the refrigerating air-conditioning system.

10. The refrigerating air-conditioning system as claimed in claim 1, wherein the heat making tank contains a heat exchanger mounted therein which functions as the condenser of the refrigerating air-conditioning system.

11. The refrigerating air-conditioning system as claimed in claim 1, wherein the intermediate heat exchanger is an air cooling type heat exchanger.

12. The refrigerating air-conditioning system as claimed in claim 1, wherein the intermediate heat exchanger is a water cooling type heat exchanger.

* * * * *